United States Patent [19]

Moodie et al.

[11] 3,945,611

[45] Mar. 23, 1976

[54] TILTING DEVICE

[76] Inventors: Rodger H. Moodie, Box 6277, Stn. J, Ottawa, Ontario; Patrick W. Fennel, 220 Redford Ave., Westmount, Quebec, both of Canada

[22] Filed: July 15, 1975

[21] Appl. No.: 596,077

[52] U.S. Cl. ..... 254/131

[51] Int. Cl.[2] ..... B66F 3/00

[58] Field of Search ..... 254/1, 120, 129, 131, 132; 294/15, 17, 62; 115/17

[56] References Cited

UNITED STATES PATENTS

| | | | |
|---|---|---|---|
| 1,586,475 | 5/1926 | Schondelmayer et al. | 294/62 |
| 2,936,192 | 5/1960 | Lince | 294/62 |
| 2,979,017 | 4/1961 | Soper | 254/120 |

FOREIGN PATENTS OR APPLICATIONS

| | | | |
|---|---|---|---|
| 459,245 | 1/1937 | United Kingdom | 294/62 |

*Primary Examiner*—Othell M. Simpson
*Attorney, Agent, or Firm*—Cushman, Darby & Cushman

[57] ABSTRACT

A device for tilting heavy objects having a handle associated with the upper surfaces of the heavy object is disclosed. The device includes an elongated base, one end of which engages the handle and the opposite end of which seats in a housing. The device also includes a lever, one end of which is pivoted in the housing and the opposite end of which has a hand grip. The lever is mounted to move away from a position approximately parallel to the elongated base through a predetermined number of degrees to an upper second position. When the lever is in this latter position, the object is tilted by applying pressure upon the hand grip of the lever.

14 Claims, 4 Drawing Figures

TILTING DEVICE

This invention relates to a tilting device that is useful for tilting heavy outboard motors out of the water, or for tilting other heavy objects.

BACKGROUND OF THE INVENTION

With the increase in demand in recent years for powered boats, both in terms of quantity and size, there has been a corresponding growth in the number and size of conventional type outboard motors. One of the problems facing a boater having a boat with a large heavy outboard motor, which is located at the rear of the boat, arises in tilting the motor into or out of the water.

Outboard motor manufacturers generally have endeavoured to solve this problem for some types of larger motors by using an auxiliary power system to tilt the motor. However, while such a system provides one answer to the problem, the cost to the motor purchaser is high.

The invention disclosed and claimed in this application provides a simple mechanical method at a reasonable cost for enabling the boater to readily cope with the problem of tilting the outboard motor into and out of the water.

The invention is also useful for other applications requiring the tilting of heavy objects. For example, in the construction industry, workers on high rise construction projects are required to manoeuver heavy construction materials such as steel beams. The device is useful in assisting the worker to readily move and locate such materials in the desired position. The tilting or moving of heavy containers for liquids from one location to another is another example. A further example can be found in the tilting or moving of heavy warehouse materials from or into the storage position in the warehouse, or to mechanical or automotive transporting means.

Therefore, this invention also provides a simple mechanical device which is inexpensive and easy to use for tilting or moving of heavy objects.

The invention can be constructed in various sizes or can be adjustable in size for use with different sized objects.

SUMMARY OF THE INVENTION

The tilting device comprises an adjustable elongated tubular base member and a lever member. The base member has two ends which are adapted to engage the object to be tilted. The first end includes flanges, and the second end is either rigidly or adjustably mounted in a housing. The lever member has two ends, one of which is pivotally mounted within the housing and the other end of which has a hand grip. The pivotal mounting and the housing enable the lever to swing through an arc from a first position, adjacent to and approximately parallel with the base member, to a second position that is a number of degrees removed from the base member. The tilting device is constructed so that the lever cannot move beyond the second position. When the lever is in the second position, the object to be tilted can be tilted by applying pressure at the hand grip in the direction that the object is to be tilted.

Where the object to be tilted is an outboard motor, the base member is constructed with flanges that engage the motor handle. The other end of the base member rests on the upper surface of the motor. The device can be constructed in different sizes or can be constructed to be adjustable to accommodate various sizes of outboard motors.

DRAWINGS

DETAILED DESCRIPTION OF THE INVENTION

Figure 1:
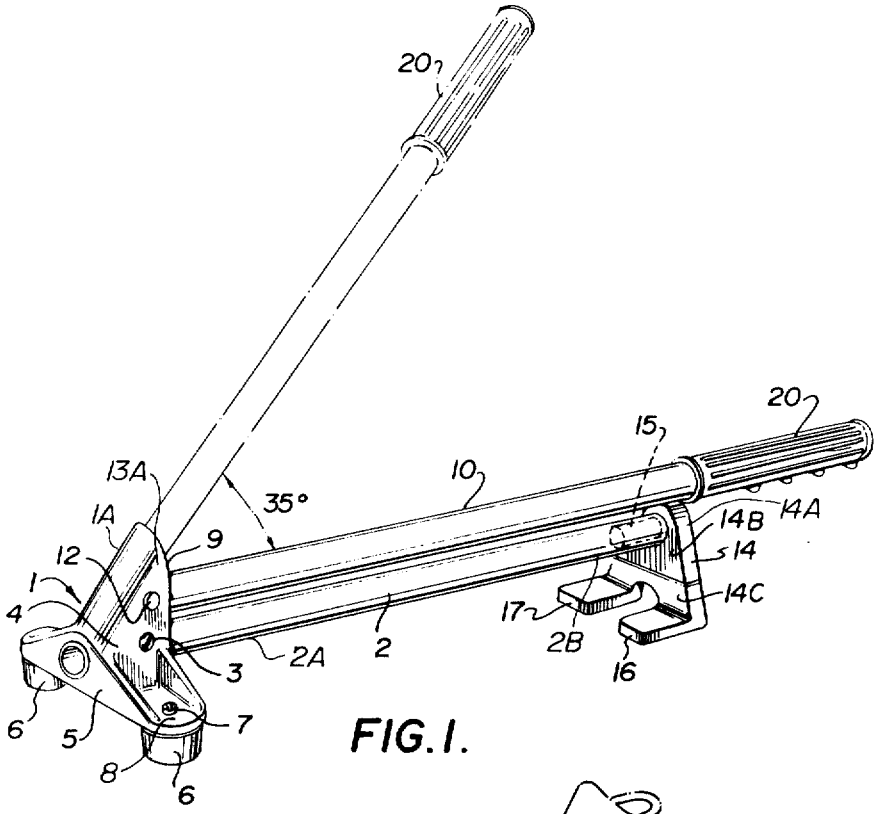
FIG. 1 is a perspective view of the tilting device with the handle of the device shown in alternative positions.

Referring to FIG. 1, the tilting device comprises an elongated base member 2 that includes a support member 14 and a housing member 1. The housing member 1, the support member 14 and the elongated base member 2 may be rigidly connected to one another, or may be detachably and adjustably connected at each of its ends to the support member 14 and the housing member 1, respectively.

An elongated rigid lever member 10 has one end thereof pivotally mounted in the housing member 1 so that the lever can pivot relative to the base member 2 along a predetermined path between a first and a second position.

The housing member 1 has an aperture extending horizontally through it from front to rear. One end 2A of the elongated base member 2 slidably fits into the aperture. The member 2 is secured in the desired location in the aperture by a set screw 3 disposed through side 4 of the housing 1. The set screw 3 is tightened until it exerts sufficient force upon the member 2A to prevent it from sliding in the aperture.

Figure 2:
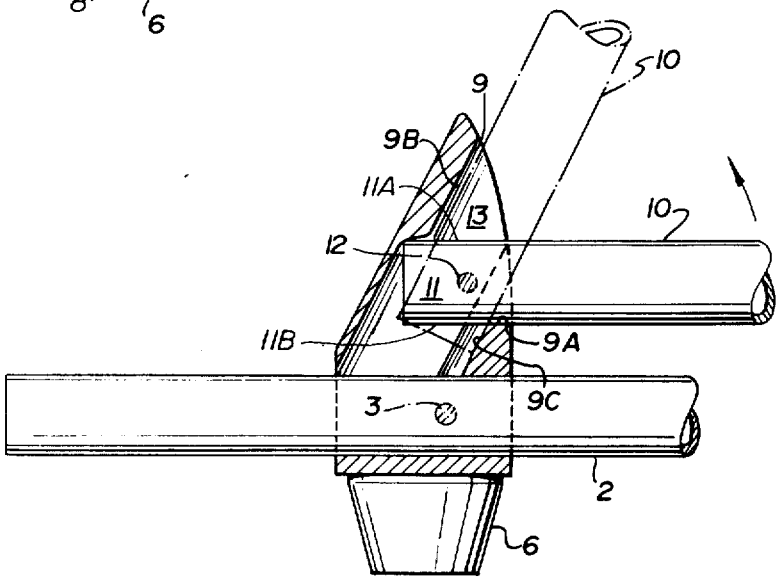
FIG. 2 is an enlarged fragmentary detail view of a portion of one embodiment of the tilting device showing the elements of the device that permit the tilting device to be adjustable in size.

As can be seen in FIG. 2, the portion of base member 2 can be adjusted relative to housing 1 by loosening set screw 3 and moving base member 2 backward or forward through the aperture in housing 1. Once the position has been selected, the set screw 3 is tightened. In FIG. 1, base member 2 is positioned so that the end of base member 2 is coincident with base 5 of housing 1. When in this position, the distance between housing 1 and support member 14 is at a maximum to accommodate large objects to be tilted. In FIG. 2, a part of the base member 2 extends out of the housing 1 and thus the distance between the housing 1 and supporting member 14 is less than maximum to accommodate smaller objects.

The base 5 of the housing 1 is supported by a pair of pads 6, illustrated in the form of rubber grommets, secured to the base 5 by screws 7. These screws 7 extend vertically through laterally disposed shoulders 8 of the base 5. These shoulders 8 by providing space between the two pads 6 thereby lending stability to the tilting device.

The base member 2 and the lever member 10 can be constructed of aluminum tubing. Other light but high tensile strength materials may also be used to form the base member 2 and lever member 10.

As may be seen in FIG. 2, the upper portion 1A of the housing 1 has an elongated opening 9 in which the lever member 10 is mounted. The end 11 of the lever member 10 has an aperture into which a pivot pin 12 is inserted. The diameter of the pin 12 is slightly less than the diameter of the aperture to permit the lever 10 to pivot about the pin 12. The pin 12 may be fixed securely within the housing wall portions 13 and 13A by flattening the ends of the pin 12 against the walls, or by welding, or by other suitable securing means.

The opening 9 meets the aperture for the tubular base member 2 at a relatively large acute angle. The portion of the housing 1 at the apex of this angle forms a bearing surface 9B. The end 11 of the lever member 10, while in its rest position (the position shown in full lines in FIGS. 1 and 2), is supported by the surface 9A and extends into the opening to a point adjacent the inside surface of the upper part of the housing 1.

In an example of the tilting device, the lever member 10 is approximately 2 feet long, and the end portion 11 dispoed within the housing 1 is approximately 3 inches long. The length of this end portion 11 provides sufficient surface area to bear against surfaces 9B and 9C on the inside wall forming the opening 9 when the lever member 10 is in its raised position. It will be appreciated that these dimensions are illustrative only, and the lever member 10 and other components of the tilting device may have a variety of different lengths as required to suit the situation.

The surfaces 9B and 9C (See FIG. 2) are located inside the upper portion of the housing 1. The surface 9B is curvilinear and of a shape corresponding to the exterior surface 11A of end 11. Thus, when lever member 10 is moved upwardly about pivot pin 12 to its operative or second position (See position shown in broken lines in FIG. 2), it will bear snugly against surface 9B. When an upward force is applied to lever member 10 when it is in the second position, much of the force is translated through surface 9B. To avoid breakage, the housing 1 is more heavily constructed or thicker in the region of surface 9B.

In the case of a tilting device having a lever 10 of approximately two feet as described above, the upper portion 1A of the housing 1 should have a thickness of approximately one-fourth inch or more in order to provide unyielding support for the end 11 of the lever member 10 when it bears against surface 9B. It has been found that a tilting device with these dimensions can be used to tilt the large outboard motors of approximately 135 horsepower and weighing about 500 pounds.

Surface 9C is of similar configuration to that of surface 9B. A portion 11B of the lever end 11 bears against surface 9C to provide additional support for the lever when the lever member 10 is in the second operative position. In the illustrative device having the dimensions mentioned hereinbefore, approximately one-fourth of an inch of the end 11 bears against the surface 9C. The thickness of the portion of the housing dividing the surface 9C from the surface 9A is approximately one-half inch.

When the lever member 10 abuts bearing surface 9B, terminal end 11 of the lever member 10 is disposed adjacent tubular base member 2. In order to provide for sufficient clearance between end 11 and base member 2, in the device having the dimensions discussed previously, the distance between surface 9A and base member 2 is in the area of one-half inch.

The tilting device in a preferred embodiment has the surfaces 9B and 9C related to the surface 9A in such a manner that the lever member 10 travels through an arc of between 33° - 35° from the first rest position to the second operative position. The surfaces 9B and 9C serve as stops to prevent further pivotal movement of the lever member 10.

Figure 3:
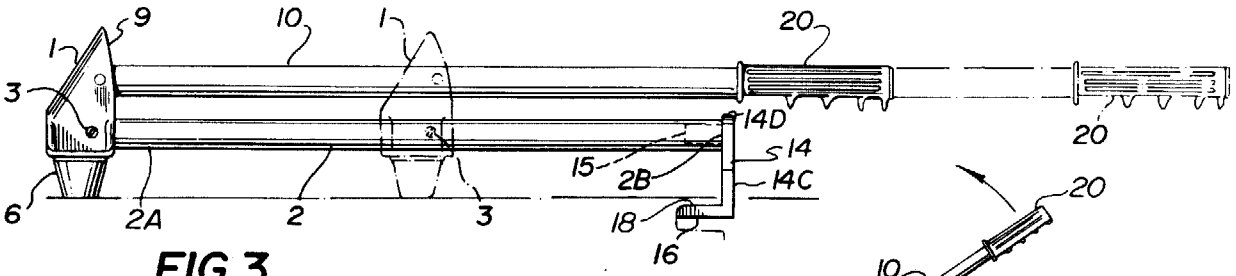
FIG. 3 is a side elevational view of embodiment of the tilting device that is adjustable illustrating the manner in which it may be adjusted to accommodate different sizes of objects to be tilted.

As can be seen in FIGS. 1 and 3, base member 2 has an opposite end 2B affixed to a support member 14. The support member 14 includes an upper plate portion 14A having a surface 14B which extends in a plane perpendicular to the axis of the base member 2. Protruding in the direction of housing 1 from surface 14B is a cylindrical projection 15 having a diameter which approximates the inside diameter of tubular base member 2. This projection 15 is firmly fixed within base member 2 to provide a mounting for end 2B of base member 2.

Figure 4:
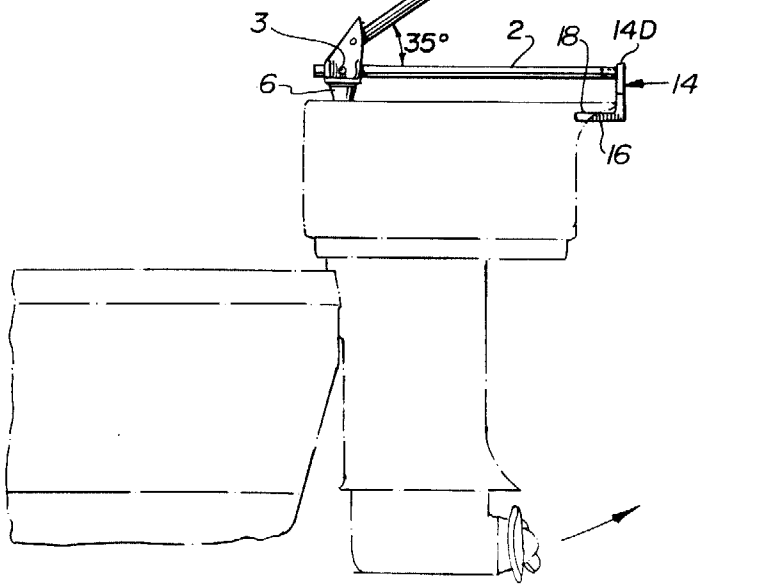
FIG. 4 is a side elevational view of the tilting device demonstrating the manner in which it fits on an outboard motor mounted at the stern of a boat.

The lower portion 14C of the support member 14 includes two flanges 16 and 17 which project from upstanding surface 14B in the direction of housing 1 in a plane substantially parallel to the base member 2. Flanges 16 and 17 are for the purpose of engaging the handle or other protrusion on the object to be tilted, for example an outboard motor, as shown in FIG. 4. In place of two flanges, a simple elongate flange in the same relative position may be used.

The flanges 16 and 17 and the other exposed surfaces of surface 14C may be coated with a resilient plastic, soft rubber or other like material 18 in order to prevent the object being tilted from being scratched or abraded, and to provide better frictional engagement with the object being tilted and thus resist slippage.

The base member 2 meets the support member 14 at a level such that the lever member 10, when in rest position, will lie adjacent to or rest against the apex 14D.

A handle or grip 20 can be disposed at the end of the lever member 10 opposite to that which pivots within the housing 1. The grip 20 preferably extends beyond the support member 14 a sufficient distance so that it can be readily gripped by the hand without interference from the support member 14 or base member 2. Normally, the lever member 10 should be sufficiently long so grip 20 is located beyond support member 14 even when the base member 2 is extended to its maximum length.

In order to use the tilting device, the device is positioned on the object to be tilted with the support member 14 and flange 16 engaging one edge of the upper surface of the object to be tilted and the two pads 6 resting on the upper surface of the object removed from the edge. If the tilting device does not fit the object to be tilted, the base member 2 can be decreased or increased in length as required by loosening the set screw 3 and moving the base member 2 relative to the housing 1 until the support member 14, housing 1 and pads 6 are in the desired positions. The set screw 3 is then retightened, the lever member 10 is pivoted to its raised operative position, and the grip 20 is pulled in a direction away from the base member 2 thereby tilting the object. If at a later time, it is desired to lower the object, the grip 20 is moved in the reverse direction to its initial rest position, and force is exerted on the grip 20 to lower the object.

The terms, words and dimensions used in this detailed description of the invention are not to be considered as limitative and equivalents or modifications that can be employed by a person skilled in the art without exercising inventive ingenuity are to be construed as coming within the scope of the invention claimed.

What is claimed is:

1. A device for tilting heavy objects, the device comprising:

base means including a support member, a housing and an elongated base member detachably and adjustably connected at each of its ends to the support member and the housing, respectively;

the support member and the housing being adapted to engage the object to be tilted;

an elongated rigid lever member having one end thereof pivotally mounted in the housing so that the lever member is pivotable relative to the base means along a predetermined path between a first and a second position;

means for adjustably connecting the base member to the housing.

2. The device of claim 1 wherein the lever member when it is in the first position is substantially parallel to the base member, and when the lever member is in the second position, it is pivoted away from the base member a predetermined number of degrees.

3. The device of claim 1 wherein the housing includes a bearing surface against which the lever member connected thereto abuts when the lever member is in the second position.

4. The device of claim 1 wherein the housing includes two bearing surfaces against which the lever member connected thereto abuts when the lever member is in the second position.

5. The device of claim 1 wherein the heavy object to be tilted is an outboard motor for a boat.

6. The device of claim 5 wherein the lever means includes gripping means located away from the end of the lever means that is connected to the housing.

7. The device of claim 6 wherein the housing includes a bearing surface against which the lever member connected thereto abuts when the lever member is in the first position.

8. The device of claim 1 wherein the object to be tilted has a protrusion therefrom and the support member includes means to engage the protrusion.

9. The device of claim 8 wherein the engaging means on the support member bears thereon a resilient coating.

10. The device of claim 9 wherein the resilient coating is slip resistant.

11. The device of claim 8 wherein the engaging means comprise two flanges which extend toward the support member and substantially parallel with the base member.

12. The device of claim 1 wherein the housing includes pads for contacting the heavy object.

13. The device of claim 1 wherein the lever member pivots in relation to the housing about a pin extending through the housing and the lever member.

14. The device of claim 3 wherein the lever member and the base member are of tubular construction and the bearing surface or surfaces are curvilinear.

* * * * *